United States Patent [19]

Lucian et al.

[11] 4,338,971

[45] Jul. 13, 1982

[54] DEVICE FOR TRANSFERRING A WEFT THREAD IN A SHUTTLELESS LOOM

[75] Inventors: Anton Lucian; Rudolf Zwiener, both of Arbon, Switzerland

[73] Assignee: Aktiengesellschaft Adolph Saurer, Arbon, Switzerland

[21] Appl. No.: 189,012

[22] Filed: Sep. 22, 1980

[30] Foreign Application Priority Data

Oct. 1, 1979 [CH] Switzerland ..... 8828/79

[51] Int. Cl.[3] ..... D03D 47/12

[52] U.S. Cl. ..... 139/194; 139/429; 139/450

[58] Field of Search ..... 139/194, 429, 430, 438, 139/439, 450; 66/145 R

[56] References Cited

U.S. PATENT DOCUMENTS

| | | | |
|---|---|---|---|
| 2,519,274 | 8/1950 | Moessinger | 139/194 |
| 3,851,677 | 12/1974 | Rossborg | 139/438 |
| 4,040,452 | 8/1977 | Santucci | 139/429 |
| 4,078,586 | 3/1978 | Porter et al. | 139/450 |

FOREIGN PATENT DOCUMENTS

| | | | |
|---|---|---|---|
| 7704471 | 10/1978 | Netherlands | 139/194 |

*Primary Examiner*—Henry Jaudon
*Attorney, Agent, or Firm*—Werner W. Kleeman

[57] ABSTRACT

A transfer device comprises a transfer lever arranged to execute an oscillatory movement and carries a thread clamp at its free end. This thread clamp comprises a leaf spring constituting a movable, controllable clamping element. The leaf spring can be raised by an actuating lever pivotally mounted on the transfer lever and which is movable relative thereto. At least one thread pick-up or entrainment element and preferably two thread pick-ups or entrainment elements, are arranged on the batten of the loom to position the weft or filling thread in the thread clamp in a predetermined position. This arrangement constitutes a relatively very simple, operationally reliable and self-cleaning transfer device.

8 Claims, 2 Drawing Figures

DEVICE FOR TRANSFERRING A WEFT THREAD IN A SHUTTLELESS LOOM

BACKGROUND OF INVENTION

The present invention relates to a new and improved device for transferring a weft or filling thread from the weft thread beat-up position to the path of movement of a weft thread picker or insertion element of a shuttleless loom, particularly a gripper loom.

More specifically, the invention is concerned with a transfer device having a transfer mechanism controllable in synchronism with the movement of the loom sley or batten. The transfer mechanism comprises a transfer lever which executes an oscillatory movement and has a thread clamp at its free end. A fixed clamping surface on the transfer lever cooperates with a movable clamping surface.

In shuttleless power looms, particularly gripper looms, it is necessary according to conventional techniques to fixedly clamp the end of the preceding weft thread in the weft thread beaten-up position and before it is cut-off, in order to then bring the newly formed leading end of the next weft thread into the path of movement of the weft thread gripper.

From Swiss Pat. No. 533,190 one such type of transfer device is already known in which the movable clamping surface is formed by an element which has a clamping jaw and which is displaceable on the transfer lever, which in this case is rotatable, and the entire arrangement being under the influence of a helical spring.

However, with this prior art arrangement, there is achieved a clamping effect which is neiher sufficiently controllable nor secure. The latter is so because there prevail considerable centrifugal forces in the region of the clamping jaw and because of the fact that the rigidity of the clamping member makes it sensitive to vibrations. Moreover, the functional reliability of this arrangement can be quickly lost by the accumulation of fluff at the transfer device. Consequently, this increases the danger that the insufficiently clamped thread will be inserted insufficiently deeply into the clamp or nipper of the weft thread gripper.

In Austrian Pat. No. 258,228 a thread clamp is proposed wherein its movable clamping surface is formed by a suitably shaped leaf spring, but the leaf spring here acts with its longitudinal axis in the picking direction of the thread, which leads to relatively indeterminable clamping conditions. Moreover, the structure is voluminous, resulting in long and thus inexact actuating paths. Likewise, there is the danger of the clamping region being obstructed or clogged by fluff.

SUMMARY OF INVENTION

It is therefore an object of the present invention to provide an improved weft thread transfer device of the character described which, while avoiding the disadvantages of the known arrangements referred to above, is insensitive to machine vibrations, has a clamping action which remains unaffected by the movement of the transfer lever, is of extremely simple conception, and in particular is self-cleaning.

This object and others are achieved in accordance with the present invention by a device for transferring a weft thread from the weft thread beaten-up position to the path of movement of a weft thread picker of a shuttleless loom, particularly a gripper loom, wherein such device comprises a transfer mechanism controllable in synchronism with the movement of the loom sley or batten. The transfer mechanism comprises a transfer lever arranged to execute an oscillatory movement and having a thread clamp at its free end, with a fixed clamping surface on the transfer lever cooperating with a movable clamping surface. According to the invention the movable clamping surface is defined by a leaf spring extending substantially perpendicular to the picking direction. An actuating lever is pivotally mounted on the transfer lever and is operatively connected to a tongue of the leaf spring to effect momentary opening of the two clamping surfaces. An adjustable stop is provided at the region of pivotal movement of the transfer lever and is arranged to cause a relative countermovement of the actuating lever when the actuating lever strikes the stop, to thereby cause said momentary opening of the two clamping surfaces.

By these measures it is now possible to construct a weft thread transfer device of the previously mentioned type which is simple and functionally reliable, having constant clamping pressure for all ranges of different thread quality, and wherein a high degree of self-cleaning of fluff and the like is achieved due to impact of the actuating lever against the stop during the pivotal movement of the transfer lever into its forward end position and by the resultant opening of the thread clamp in a phase of maximum deceleration, causing pieces or particles of dirt and fluff to be thrown out by the centrifugal force.

In order to be able to adjust the clamping pressure between the two clamping surfaces it is preferable to mount the leaf spring to be tiltable on a pin. Setting means, such as a setting or adjustment screw, mounted on the transfer lever are arranged to act on a second tongue projecting from the leaf spring in the region where the pin is mounted, the setting means exerting a torque or rotational moment upon the leaf spring which is effective in the clamping direction.

According to a further preferred feature of the invention, a positioning nose for the weft thread extends upwards from the outside marginal edge of the fixed clamping surface on the transfer lever and determines the depth of insertion of the weft or filling thread between the two clamping surfaces at said outside edge.

By means of this arrangement the thread can adopt a position which extends rearwardly at an inclined angle, so that the thread can be reliably gripped by the weft thread gripper over a long effective clamping tension and can be protectively removed from the clamp.

It is advantageous if there is mounted at the sley or batten of the loom at least one thread pick-up or entrainment member arranged to skirt the outside marginal edge of the fixed clamping surface in order to push the weft thread towards the positioning nose.

A further thread pick-up or entrainment member can be arranged to skirt close to the other, inside marginal edge of the fixed clamping surface and also can be secured to the batten or sley for conjoint movement with the aforementioned first thread pick-up or entrainment member. Preferably, the second thread pick-up is offset relative to the first and is arranged to lead the same in the direction of the beating-up movement of the batten. By virtue of this arrangement the thread can adopt a more accurately defined inclined position between the clamping surfaces.

A notch can serve as a stop for the weft thread drawn into the clamp by the second thread pick-up or entrainment member. This notch can be formed by a partial bevelling of the inside marginal edge of the fixed clamping surface.

From the forward edge of this bevelling backwards towards the positioning nose the free front edge of the fixed clamping surface can be arranged to extend at an inclination so that the aforementioned bevelling extends practically to a projecting or protruding nose of the clamping surface.

When with this arrangement the weft thread gripper grips the thread presented by the transfer device, the thread is very carefully and gently released from the thread clamp, with the thread sliding along the bevelling, so that, as mentioned, the clamping action on the thread is maintained effective right up to the picking movement.

BRIEF DESCRIPTION OF THE DRAWINGS

In order that the invention may be fully understood certain preferred embodiments of device in accordance with the invention will now be described by way of example and with reference to the accompanying drawing, in which.

DETAILED DESCRIPTION OF THE PREFERRED EMBODIMENTS

Figure 1:
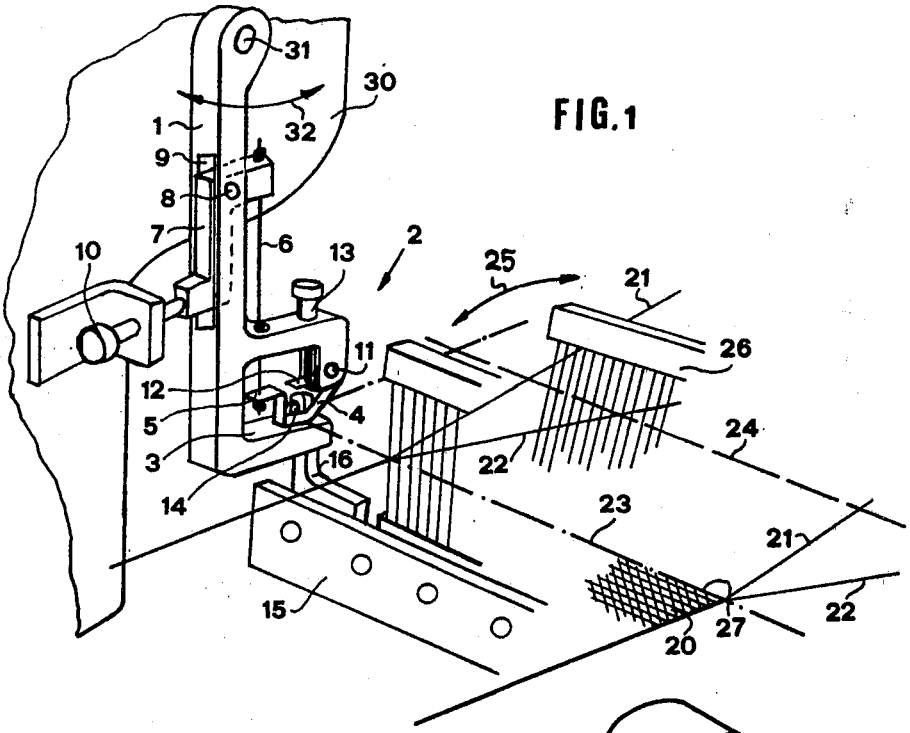
FIG. 1 is a diagrammatic illustration of the device constructed in accordance with the invention for the transfer of a weft thread in a loom.

FIG. 1 shows part of a gripper power loom, the view being taken through a section of a woven fabric piece 20 with the shed formed by the upper set of warp threads 21 and the lower set of warp threads 22. Each of the weft or filling threads 23 is inserted through the shed between the two sets of warp threads 21 and 22 by means of a weft thread gripper, which is not particularly shown. The path of movement of this weft thread gripper is indicated by the broken line 24.

As is known, each inserted weft thread 23 is beaten-up against the fell 27 of the woven material or fabric 20 by means of a reed 26 which is connected to a sley or batten 15 and which is reciprocable back-and-forth together with the batten, as generally indicated by the double-headed arrow 25. Thereafter, each inserted weft thread 23 is cut at the selvedges of the woven fabric 20 by conventional cutting means (not shown).

In order to be able to subsequently bring the end of the previously inserted weft thread 23, after the cutting operation, into the path of movement 24 of the weft thread gripper, so that it can become the beginning of the next weft thread, the device of the present invention incorporates a transfer lever 1 fixedly connected for rotation to a shaft 31 mounted on the machine frame 30. This transfer lever 1 carries at its free end a thread clamp 2 which will be described in greater detail hereinafter.

The aforementioned shaft 31 is driven in any suitable manner in synchronism with the reciprocating movement of the batten 15 of the power loom in alternating directions of rotation. As a result the transfer lever 1 is caused to execute an oscillatory movement, as generally indicated by the double-headed arrow 32.

The aforementioned thread clamp 2 includes a fixed clamping surface 3 formed on the transfer lever 1 and a movable clamping surface 4' defined by part of a leaf spring 4.

The leaf spring 4 or equivalent structure, which is bent upwards from its clamping surface 4', is tiltably mounted on a pin 11. A setting screw 13 which is mounted on the transfer lever 1 acts on a tonque 12 projecting from the leaf spring 4 at the region where the pin 11 is mounted. This setting screw 13 enables an adjustment of the torque acting in the clamping direction and consequently an adjustment of the clamping force exerted by the leaf spring 4.

In order to open the thread clamp 2 by raising the leaf spring 4 from the fixed clamping surface 3, the arrangement includes an actuating lever 7 which is mounted on a pin 8 carried by the transfer lever 1 for pivotal movement relative to such transfer lever 1. The actuating lever 7 is here substantially Z-shaped and sits in a slot 9 in the transfer lever 1. With this arrangement the actuating lever 7 has its lower lever arm arranged to cooperate with a spatially fixed stop 10 which is located within the range of pivotal movement of the transfer lever 1. On the other hand, the upper arm of the actuating lever 7 is connected to a tongue 5 formed on the other end of the leaf spring 4 by means of a tension wire 6 or the like.

When, with this arrangement, the transfer lever 1 is pivoted in the clockwise sense towards the stop 10, the actuating lever 7 is stopped in its movement, and consequently, this causes a relative counter movement to be imparted to the actuating lever which results in raising of the leaf spring 4 and thus opening of the thread clamp 2.

Figure 2:
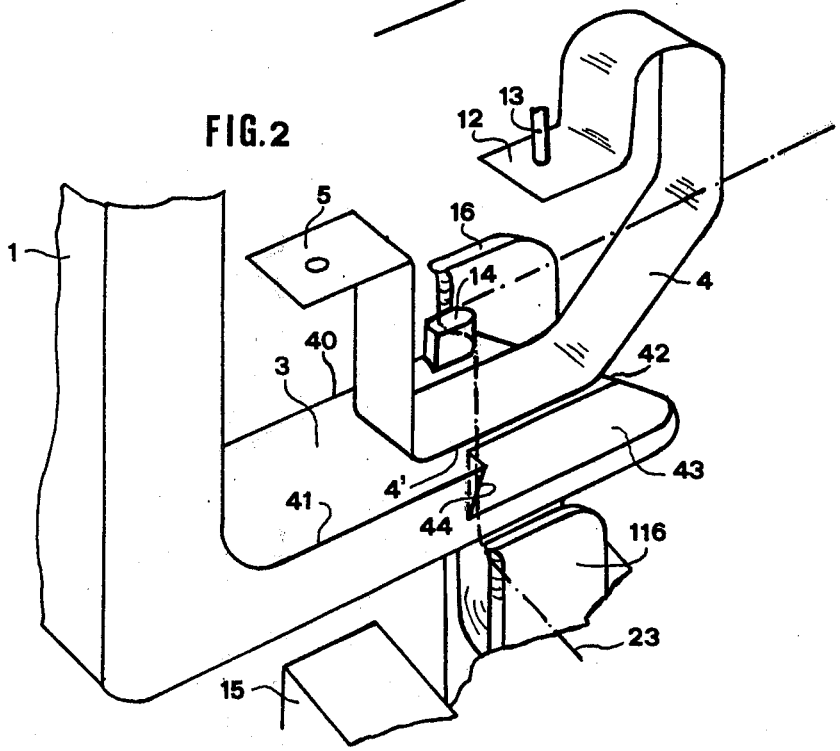
FIG. 2 is a diagrammatic illustration of a modified embodiment of a detail part of the arrangement shown in FIG. 1 and shown on an enlarged scale.

As FIG. 2 shows in greater detail, a positioning nose 14 for the weft thread 23 projects upwardly from the outside marginal edge 40 of the fixed clamping surface 3 on the transfer lever 1. This positioning nose 14 determines the outer insertion position of the weft thread 23 between the two clamping surfaces 3 and 4'.

As FIGS. 1 and 2 further show, a thread pick-up or entrainment member 16 cooperates with the positioning nose 14 for the weft thread 23 at the outside marginal edge 40 of the fixed clamping surface 3. This thread pick-up or entrainment member 16 is arranged fixedly on the batten 15 of the loom so as to be able to skirt close by the outside marginal edge 40. Upon forward movement of the batten 15 during the beating-up phase, the thread pick-up or entrainment member 16 guides the weft thread 23 into contact with the positioning nose 14 and between the two thread clamping surfaces 3 and 4'.

As an alternative to this arrangement it is possible to have, as shown in FIG. 2, a further thread pick-up or entrainment member 116 which is fixed for conjoint movement with the aforementioned first thread pick-up 16 on the batten 15, so as to be able to skirt close to the inside marginal edge 41 of the fixed clamping surface 3. Preferably, the second thread pick-up 116 is offset relative to the first pick-up 16 and is arranged to lead in advance of it in the beating-up direction of the batten 15. Thus, the thread 23 can assume an accurately defined inclined position between the clamping surfaces 3, 4', starting from the positioning nose 14 and extending across the transfer lever 1, as can be seen clearly from FIG. 2.

These measures ensure that the weft thread 23 can be gripped securely by the weft thread gripper over a long effective clamping span and can be inserted deeply into the nipper or clamp of the weft thread gripper.

As a stop for the weft thread entrained by the second or inside thread pick-up or entrainment member 116 there can be provided a notch or groove 44 which is formed by a partial bevelling 43 of the inside marginal edge 41 of the fixed clamping surface 3.

From the forward edge of the bevel 43 rearwards towards the positioning nose 14 the free front face 42 of the fixed clamping surface 3 extends at an angle or inclination, so that the bevel 43 terminates in effect in a projecting nose of the clamping surface 3.

When, with this arrangement, the weft thread gripper grips the weft thread 23 presented by the transfer device, then this weft thread 23 is very carefully and gently released from the thread clamp 2, because the thread 23 can slide along against the inclined front face 42, with the result that the clamping action on the thread is maintained right up to the picking of the thread.

These measures permit the inserted weft thread 23 to be pushed into the momentarily open thread clamp 2, and there held fast, simultaneously with it being beaten-up against the fell or woven edge 27 of the fabric 20. Subsequently, the cutting operation can be carried out with conventional means which therefore are not particularly shown. Thereafter, the thread end, i.e. what is now the beginning of the next weft thread, is brought back by pivotal movement of the transfer lever 1 in the counter-clockwise sense into the path of movement 24 of the weft thread gripper and is there taken-up by the gripper in the manner described above.

It will be clearly apparent that the concept and design of the aforementioned weft thread transfer device is simple and functionally reliable, especially in terms of achieving a constant clamping pressure, even with the most varied types of thread quality, and that also, as described above, there is additionally attained good self-cleaning of the transfer device.

While there are shown and described present preferred embodiments of the invention, it is to be distinctly understood that the invention is not limited thereto, but may be otherwise variously embodied and practiced within the scope of the following claims. Accordingly,

What we claim is:

1. A device for transferring a weft thread from a weft thread beaten-up position to a path of movement of a weft thread picker of a shuttle loom having a batten, particularly a gripper loom, comprising:

a transfer mechanism controllable in synchronism with the movement of a loom batten;

said transfer mechanism comprising:

a transfer lever mounted for executing an oscillatory movement;

said transfer lever including a fixed clamping surface cooperating with a movable clamping surface;

said movable clamping surface being constituted by a leaf spring extending substantially perpendicular to a picking direction of the weft thread;

an actuating lever pivotably mounted on the transfer lever;

said leaf spring having a tongue;

means for connecting said actuating lever with said tongue of the leaf spring to effect momentary opening of said two clamping surfaces; and an adjustable stop provided at the region of the pivotal movement of the transfer lever and arranged to cause a relative countermovement of the actuating lever when the actuating lever strikes said stop, in order to thereby cause momentary opening of said two clamping surfaces.

2. The weft thread transfer device as defined in claim 1, further including:

means for tiltably mounting said leaf spring;

setting means mounted on said transfer lever;

said leaf spring having a further tongue projecting therefrom at the region of mounting of said leaf spring;

said setting means acting upon said second tongue; and said setting means exerting a torque upon the leaf spring which is effective in the clamping direction of said two clamping surfaces.

3. The weft thread transfer device as defined in claim 1, further including;

a positioning nose provided for said weft thread;

said fixed clamping surface on said transfer lever having an outside marginal edge; and said positioning nose extending upwardly from said outside marginal edge of the fixed clamping surface of the transfer lever and determining the depth of insertion of the weft thread between the two clamping surfaces at said outside marginal edge.

4. The weft thread transfer device as defined in claim 3, further including:

at least one thread entrainment member adapted to be connected to the batten of the loom and arranged for displacing the weft thread towards said positioning nose;

said weft thread entrainment member being arranged to skirt the outside marginal edge of the fixed clamping surface and defining an outside weft thread entrainment member.

5. The weft thread transfer device as defined in claim 4, further including:

a further weft thread entrainment member adapted to be connected to the batten of the loom;

said fixed clamping surface having a stop surface at an inside marginal edge;

said weft thread entrainment member being arranged for pushing the weft thread towards said stop surface on said inside marginal edge of the fixed clamping surface and defining an inside weft thread entrainment member;

said inside weft thread entrainment member being positioned so as to skirt said inside marginal edge of the fixed clamping surface.

6. The weft thread transfer device as defined in claim 5, wherein:

said stop surface is defined by a notch formed by a partial bevelled portion of the inside marginal edge of the fixed clamping surface.

7. The weft thread transfer device as defined in claim 6, wherein:

said inside weft thread entrainment member is offset in relation to the outside weft thread entrainment member and leads the latter in the direction of beating-up movement of the batten.

8. The weft thread transfer device as defined in claim 7, wherein:

said fixed clamping surface has a free front edge towards which moves the weft thread which is to be clamped;

said fixed clamping surface having a projecting inside marginal edge; and said free front edge of said fixed clamping surface extending at an inclination from said inside marginal edge of the fixed clamping surface rearwardly towards said positioning nose.

* * * * *